US006936396B2

(12) United States Patent
Patel

(10) Patent No.: US 6,936,396 B2
(45) Date of Patent: Aug. 30, 2005

(54) TONER PROCESSES

(75) Inventor: Raj D. Patel, Oakville (CA)

(73) Assignee: Xerox Corporation, Stamford, CT (US)

( * ) Notice: Subject to any disclaimer, the term of this patent is extended or adjusted under 35 U.S.C. 154(b) by 143 days.

(21) Appl. No.: 10/603,321

(22) Filed: Jun. 25, 2003

(65) Prior Publication Data

US 2004/0265729 A1 Dec. 30, 2004

(51) Int. Cl.[7] ..... G03G 9/08
(52) U.S. Cl. ..... 430/137.14; 430/137.1; 523/335
(58) Field of Search ..... 430/137.1, 137.14; 523/335

(56) References Cited

U.S. PATENT DOCUMENTS

| | | | | |
|---|---|---|---|---|
| 4,128,202 | A | 12/1978 | Buros | 235/493 |
| 4,517,268 | A | 5/1985 | Gruber et al. | 430/39 |
| 4,859,550 | A | 8/1989 | Gruber et al. | 430/39 |
| 5,034,298 | A | 7/1991 | Berkes et al. | 430/110 |
| 5,290,654 | A | 3/1994 | Sacripante et al. | 430/137 |
| 5,510,221 | A | 4/1996 | Matalevich et al. | 430/106.6 |
| 5,780,190 | A | 7/1998 | Listigovers et al. | 430/39 |
| 5,910,387 | A | 6/1999 | Mychajlowskij et al. | 430/110 |
| 5,914,209 | A | 6/1999 | Grushkin | 430/106.6 |
| 5,916,725 | A | 6/1999 | Patel et al. | 430/137 |
| 5,919,595 | A | 7/1999 | Mychajlowskij et al. | 430/137 |
| 5,922,501 | A | 7/1999 | Cheng et al. | 430/137 |
| 5,925,488 | A | 7/1999 | Patel et al. | 430/137 |
| 5,945,245 | A | 8/1999 | Mychajlowskij et al. | 430/137 |
| 5,977,210 | A | 11/1999 | Patel et al. | 523/161 |
| 6,132,924 | A | 10/2000 | Patel et al. | 430/137 |
| 6,268,102 | B1 | 7/2001 | Hopper et al. | 430/137.14 |
| 6,416,920 | B1 | 7/2002 | Hopper et al. | 430/137.14 |
| 6,495,302 | B1 | 12/2002 | Jiang et al. | 430/137.14 |
| 6,500,597 | B1 | 12/2002 | Patel et al. | 430/137.14 |
| 6,541,175 | B1 | 4/2003 | Jiang et al. | 430/137.14 |
| 6,562,541 | B2 * | 5/2003 | Vanbesien et al. | 430/137.14 |
| 6,576,389 | B2 | 6/2003 | Vanbesien et al. | 430/137.14 |
| 6,656,658 | B2 * | 12/2003 | Patel et al. | 430/137.14 |
| 6,767,684 | B1 * | 7/2004 | Patel et al. | 430/137.14 |

OTHER PUBLICATIONS

Copending U.S. Appl. No. 10/354,228, filed Jan. 29, 2003, on "Toner Processes" by Raj D. Patel et al.
Copending U.S. Appl. No. 10/106,519, filed Mar. 25, 2002, on "Toner Processes" by Raj D. Patel et al.
Copending U.S. Appl. No. 10/106,514, filed Mar. 25, 2002, on "Toner Processes" by Raj D. Patel et al.
Copending U.S. Appl. No. 10/106,473, filed Mar. 25, 2002, on "Toner Processes" by Raj D. Patel et al.
Copending U.S. Appl. No. 10/106,512, filed Mar. 25, 2002, on "Magnetite Toner Processes" by Raj D. Patel et al.

* cited by examiner

*Primary Examiner*—John L Goodrow
(74) *Attorney, Agent, or Firm*—E. D. Palazzo

(57) ABSTRACT

A toner process comprised of heating a mixture of an acicular magnetite dispersion, a colorant dispersion, a wax dispersion, a first latex containing a crosslinked resin, a second latex containing a resin substantially free of crosslinking, a coagulant and a silica, and wherein the toner resulting possesses a shape factor of from about 120 to about 150.

32 Claims, No Drawings

TONER PROCESSES

RELATED APPLICATIONS AND PATENTS

Illustrated in copending application U.S. Ser. No. 10/606,330, Publication No. 2004/0265728, filed concurrently herewith, the disclosure of which is totally incorporated herein by reference, is a toner process comprised of heating a mixture of an acicular magnetite dispersion, a colorant dispersion, a wax dispersion, a first latex containing a crosslinked resin, and a second latex containing a resin free of crosslinking in the presence of a coagulant to provide aggregates, stabilizing the aggregates with a silicate salt dissolved in a base, and further heating said aggregates to provide coalesced toner particles.

Illustrated in copending application U.S. Ser. No. 10/606,298, filed concurrently herewith, the disclosure of which is totally incorporated herein by reference, is a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein said first heating is below about the latex polymer glass transition temperature (Tg), and said second heating is about above the latex polymer glass transition temperature.

Illustrated in copending application U.S. Ser. No. 10/603,449, Publication No. 2004/0265727, filed concurrently herewith, the disclosure of which is totally incorporated herein by reference, is a toner process comprised of a first heating of a colorant dispersion, a latex emulsion, and a wax dispersion in the presence of a coagulant containing a metal ion; adding a silicate salt; followed by a second heating.

Illustrated in U.S. Pat. No. 6,617,092 on Toner Processes, filed Mar. 25, 2002, the disclosure of which is totally incorporated herein by reference, is a process for the preparation of a magnetic toner comprising heating a colorant dispersion containing acicular magnetite a carbon black dispersion, a latex emulsion, and a wax dispersion.

Illustrated in U.S. Pat. No. 6,627,373 on Toner Processes, filed Mar. 25, 2002, the disclosure of which is totally incorporated herein by reference, is a process for the preparation of a magnetic toner comprising the heating of a colorant dispersion comprised of a magnetite dispersion, and a carbon black dispersion, and thereafter mixing with a basic cationic latex emulsion and a wax dispersion.

Illustrated in U.S. Pat. No. 6,541,175, filed Feb. 4, 2002 on Toner Processes, the disclosure of which is totally incorporated herein by reference, is a process comprising:

(i) providing or generating an emulsion latex comprised of sodio sulfonated polyester resin particles by heating the particles in water at a temperature of from about 65° C. to about 90° C.;

(ii) adding with shearing to the latex (i) a colorant dispersion comprising from about 20 percent to about 50 percent of a predispersed colorant in water, followed by the addition of an organic or an inorganic acid;

(iii) heating the resulting mixture at a temperature of from about 45° C. to about 65° C. followed by the addition of a water insoluble metal salt or a water insoluble metal oxide thereby releasing metal ions and permitting aggregation and coalescence, optionally resulting in toner particles of from about 2 to about 25 microns in volume average diameter; and optionally (iv) cooling the mixture and isolating the product.

Illustrated in copending application U.S. Ser. No. 10/106,473, Publication No. 2003/0180648, on Toner Processes, filed Mar. 25, 2002, the disclosure of which is totally incorporated herein by reference, is a process for the preparation of a toner comprising mixing a colorant dispersion comprising an acicular magnetite dispersion and a carbon black dispersion with a latex, a wax dispersion and a coagulant.

Illustrated in U.S. Pat. No. 6,656,658 filed Mar. 25, 2002 on Magnetite Toner Processes, the disclosure of which is totally incorporated herein by reference, is a toner process comprising heating a mixture of an acidified dispersion of an acicular magnetite with a colorant dispersion of carbon black, a wax dispersion, and an acidic latex emulsion.

Illustrated in U.S. Pat. No. 6,656,657 filed Mar. 25, 2002 on Toner Processes, the disclosure of which is totally incorporated herein by reference, is a toner process comprising heating an acidified dispersion of an acicular magnetite with an anionic latex, an anionic carbon black dispersion, and an anionic wax dispersion.

Illustrated in U.S. Pat. No. 6,495,302, filed Jun. 11, 2001 on Toner Coagulant Processes, the disclosure of which is totally incorporated herein by reference, is a process for the preparation of toner comprising (i) generating a latex emulsion of resin, water, and an ionic surfactant, and a colorant dispersion of a colorant, water, an ionic surfactant, or a nonionic surfactant, and wherein (ii) the latex emulsion is blended with the colorant dispersion;

(iii) adding to the resulting blend containing the latex and colorant a coagulant of a polyaluminum chloride with an opposite charge to that of the ionic surfactant latex colorant;

(iv) heating the resulting mixture below or equal to about the glass transition temperature (Tg) of the latex resin to form aggregates;

(v) optionally adding a second latex comprised of submicron resin particles suspended in an aqueous phase (iv) resulting in a shell or coating wherein the shell is optionally of from about 0.1 to about 1 micron in thickness, and wherein optionally the shell coating is contained on 100 percent of the aggregates;

(vi) adding an organic water soluble or water insoluble chelating component to the aggregates of (v) particles, followed by adding a base to change the resulting toner aggregate mixture from a pH which is initially from about 1.9 to about 3 to a pH of about 5 to about 9;

(vii) heating the resulting aggregate suspension of (vi) above about the Tg of the latex resin;

(viii) optionally retaining the mixture (vii) at a temperature of from about 70° C. to about 95° C.;

(ix) changing the pH of the (viii) mixture by the addition of an acid to arrive at a pH of about 1.7 to about 4; and (x) optionally isolating the toner.

Illustrated in U.S. Pat. No. 6,500,597, filed Aug. 6, 2001 on Toner Coagulant Processes, the disclosure of which is totally incorporated herein by reference, is a process comprising (i) blending a colorant dispersion of a colorant, water, and an anionic surfactant, or a nonionic surfactant with (ii) a latex emulsion comprised of resin, water, and an ionic surfactant;

(iii) adding to the resulting blend a first coagulant of polyaluminum sulfosilicate (PASS) and a second cationic co-coagulant having an opposite charge polarity to that of the latex surfactant;

(iv) heating the resulting mixture below about the glass transition temperature (Tg) of the latex resin;

(v) adjusting with a base the pH of the resulting toner aggregate mixture from a pH which is in the range of about 1.8 to about 3 to a pH range of about 5 to about 9;

(vi) heating above about the Tg of the latex resin;

(vii) changing the pH of the mixture by the addition of a metal salt to arrive at a pH of from about 2.8 to about 5; and (viii) optionally isolating the product.

Illustrated in U.S. Pat. No. 6,576,389. filed Oct. 15, 2001 on Toner Coagulant Processes, the disclosure of which is totally incorporated herein by reference, is a process for the preparation of toner comprising mixing a colorant dispersion, a latex emulsion, a wax dispersion and coagulants comprising a colloidal alumina coated silica, and a polymetal halide.

Illustrated in U.S. Pat. No. 6,767,684 filed Jan. 29, 2003, the disclosure of which is totally incorporated herein by reference, is a toner process comprising mixing a colorant dispersion comprising an acicular magnetite dispersion and a colorant with a latex containing a crosslinked resin, a latex containing a resin free of crosslinking, a wax dispersion, a resin, and a coagulant.

The appropriate components, such as for example, magnetites, waxes, coagulants, resin latexes, surfactants, and colorants, and processes of the above copending applications may be selected for the present invention in embodiments thereof.

BACKGROUND

This invention relates to toner processes, and more specifically, to aggregation and coalescence processes. More specifically, the present invention relates in embodiments to methods for the preparation of toner compositions by a chemical process, such as emulsion/aggregation/coalescence wherein latex particles are aggregated with a wax, a crosslinked gel with, for example, from about 20 to about 55 percent gel as measured gravimetrically, colorants, a magnetite and colloidal silica in the presence of a coagulant like a polymetal halide, or alternatively a mixture of coagulants or flocculating agents, thereafter stabilizing the aggregates with a solution of an alkali metal hydroxide like sodium hydroxide, and thereafter coalescing or fusing by heating the mixture above the resin Tg to provide toner size particles which when developed by an electrographic process generates documents suitable for magnetic image character recognition or MICR.

A number of advantages are associated with the present invention in embodiments thereof including, for example, excellent toner hot offset, for example above about 210° C., and more specifically, from about 210° C. to about 230° C.; a toner fusing latitude of from about 20° C. to about 35° C., wherein fusing latitude refers to a temperature in which, when a developed image is fused, evidences substantially no offset either to the substrate that the image is fused on, referred to as "Cold" offset or an offset on the fuser roll referred to as the "HOT" offset; a toner minimum fixing temperature of, for example, about 170° C. to about 195° C.; and extended photoreceptor life since the toner fusing temperature can be below about 195° C., such as from about 175° C. to about 190° C.; and also in embodiments a process that enables a means of identifying how a toner was fabricated by, for example, analyzing for aluminum and silica contents.

REFERENCES

In U.S. Pat. No. 6,132,924, the disclosure of which is totally incorporated herein by reference, there is illustrated a process for the preparation of toner comprising mixing a colorant a latex, and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant a latex, and a coagulant, followed by aggregation and coalescence, wherein the coagulant may be a polyaluminum sulfosilicate.

Also, in U.S. Pat. No. 6,416,920, the disclosure of which is totally incorporated herein by reference, there is illustrated a process for the preparation of toner comprising mixing a colorant, a latex, and a silica, which silica is coated with an alumina.

Disclosed in U.S. Pat. No. 4,128,202, the disclosure of which is totally incorporated herein by reference, is a device for transporting a document that has been mutilated or erroneously encoded and wherein there is provided a predetermined area for the receipt of correctly encoded magnetic image character recognition information (MICR). As indicated in this patent, the information is referred to as MICR characters, which characters can appear, for example, at the bottom of personal checks as printed numbers and symbols. These checks have been printed in an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent, are generally segregated into three separate fields, the first field being termed a transient field, which contains the appropriate symbols and characters to identify the bank, bank branch, or the issuing source.

In U.S. Pat. No. 5,914,209, the disclosure of which is totally incorporated by reference, there is illustrated a process for preparing MICR toners using a combination of hard and soft magnetites, and a lubricating wax and melt mixing with a resin followed by jetting and classifying the blend to provide toner compositions.

In U.S. Pat. No. 4,517,268, the disclosure of which is totally incorporated by reference, there is illustrated a process for preparing MICR toners using styrene copolymers, such as styrene butadiene, by melt mixing in a Banbury apparatus, followed by pulverizing the magnetite and the resin, followed by jetting and classifying to provide, for example, 10 to 12 micron toner size particles which when mixed with an additive package and a carrier provides a developer suitable for use the Xerox Corporation 9700®.

Further patents relating to MICR processes are U.S. Pat. Nos. 4,859,550; 5,510,221; and 5,034,298, illustrating, for example, the generation of MICR toners by conventional means such as that described in U.S. Pat. No. 4,517,268.

In applications for MICR capabilities, the toners selected usually contain magnetites having specific properties, an important one of which is a high enough level of remanence or retentivity. Retentivity is a measure of the magnetism left when the magnetite is removed from the magnetic field, that is, the residual magnetism. Also of value are toners with a high enough retentivity, such that when the characters are read, the magnetites produce a signal strength of equal to greater than about 100 percent. The signal level can vary in proportion to the amount of toner deposited on the document being generated, and signal strength of a toner composition can be measured by using known devices, including the MICR-Mate 1, manufactured by Checkmate Electronics, Inc.

In U.S. Pat. No. 5,780,190, the disclosure of which is totally incorporated herein by reference, there is disclosed an ionographic process which comprises the generation of a latent image comprised of characters; developing the image with an encapsulated magnetic toner comprised of a core comprised of a polymer and a soft magnetite, and wherein the core is encapsulated within a polymeric shell; and subsequently providing the developed image with magnetic ink characters thereon to a reader/sorter device.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. The components and processes of these Xerox patents can be selected for the present invention in embodiments thereof.

In addition, the following U.S. Patents relate to emulsion aggregation toner processes, the disclosures of which are totally incorporated herein by reference.

U.S. Pat. No. 5,922,501 illustrates a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 illustrates a surfactant free process for the preparation of toner comprising heating a mixture of an emulsion latex, a colorant, and an organic complexing agent.

SUMMARY

It is a feature of the present invention to provide a toner with a number of the advantages illustrated herein, and more specifically, a silica coated magnetite containing toner for Magnetic Ink Character Recognition (MICR) processes by, for example, selecting specific magnetites that provide an acceptable readability signal by a check reader, and wherein the resulting toners possess a sufficient magnetic signal, desirable melt fusing, hot offset, and fusing latitude temperatures, and which toners also contain a gel or a crosslinked resin.

In another feature of the present invention, there are provided aggregation coalescence toner processes that provide toners with a narrow particle size distribution.

Aspects of the present invention relate to a toner process comprising heating a mixture of an acicular magnetite dispersion, a colorant dispersion, a wax dispersion, a first latex containing a crosslinked resin, a second latex containing a resin substantially free of crosslinking, a coagulant and a silica, and wherein the toner resulting possesses a shape factor of from about 120 to about 150; a process comprising heating a mixture of an acicular shaped magnetite dispersion, a black colorant dispersion, a crosslinked resin latex, a latex containing a resin free of crosslinking, and a coagulant, and wherein the heating involves a first heating and subsequently a second heating, and which second heating is at a higher temperature than the first heating, the second heating being above about the glass transition temperature (Tg) of the resin free of crosslinking; a process comprising heating a magnetite, a latex containing a crosslinked polymer, a latex containing a polymer substantially free of crosslinking, a coagulant, and a colloidal silica, and wherein the heating involves a first heating equal to about or below about the Tg of the resin free of crosslinking, and a second heating equal to about or above about the Tg of the resin free of crosslinking; the preparation of MICR toners wherein the toner comprises magnetite, resin, wax, silica and crosslinked gel particles wherein the silica is introduced in the form of a silicate salt dissolved in sodium hydroxide, and which solution possesses a suitable pH, and wherein silica binds or coats the magnetite or the aggregate particles containing the magnetite thereby allowing the pH during coalescence to be lowered below the Point of Zero Charge of the uncoated magnetite, for example equal to or less than about 5; a process wherein the coating of silica on the magnetite particles lowers the Pzc from a value of about 5.4 to about 3.5 enabling the pH during coalescence to be reduced to about 4 to about 5 without any toner size increase, thereby providing a broader process latitude and more rapid coalescence, which coalescence can be reduced by about 40 percent; a toner process wherein there is selected a silica in the form of a silicate salt present on oxide particles such as titanium, aluminum, zirconium and in particular magnetite which exhibit dual charge capabilities depending on the pH of the surrounding media, allowing these particles to function as coagulating/flocculating agents for an anionic or a cationic process, and wherein the addition of the silicate salt forms a coating of silica on the magnetite aggregates thereby reducing or lowering the Pzc, for example from about 5.3 to about 3.5; a toner process wherein the toner formed can be of various shapes, such as a potato like shape to spherical shape by, for example, reducing the pH during coalescence below a pH of 5; a MICR toner containing the in situ incorporation of silica wherein silica is introduced in the form of a silicate salt, which is dissolved in a base; a MICR toner containing silica and prepared by emulsion aggregation processes wherein the magnetite is in the form of needle shape or acicular magnetite particles, which are of a size diameter of, for example, from about 450 nanometers to about 700 nanometers; a toner process involving the silica incorporation by the introduction of an aqueous solution of a silicate salt dissolved in a base, which base is introduced into an aggregate mixture prior to increasing the temperature of the aggregate particles above the resin Tg to achieve coalescence or fusion; a toner process that is capable of incorporating into toners needle shape or acicular magnetites, which have a coercivity of about 350 oersteds (Oe), which is about 2 to about 3 times that of cubic or spherical magnetite, which have a coercivity of about 110 oersteds, to provide an adequate magnetic signal, for example greater then 100 percent, where 100 percent refers, for example, to the nominal signal for readability by a check reader; the preparation of a MICR toner by emulsion aggregation processes wherein the amount of acicular magnetite loading is about 23 to about 35 weight percent of toner, or about 45 to about 65 weight percent to provide an adequate magnetic signal for readability by a check reader; a process wherein (i) the acicular magnetite dispersion contains water and an anionic surfactant, or a nonionic surfactant, the colorant dispersion of carbon black contains water and an anionic surfactant, or a nonionic surfactant, and the wax dispersion is comprised of submicron wax particles of from about 0.1 to about 0.5 micron in diameter by volume, and which wax is dispersed in water and an anionic surfactant to provide a mixture containing magnetite, colorant, and a wax;

(ii) wherein the mixture of (i) is blended with a latex emulsion comprised of submicron noncrosslinked resin particles in the size diameter range of about 150 to about 300 nanometers, and containing water, an anionic surfactant or a nonionic surfactant, and a second latex comprised of submicron crosslinked gel particles in the size diameter range of about 30 to about 150 nanometers containing water and an anionic surfactant or a nonionic surfactant to provide a blend of magnetite, colorant, wax and resins;

(iii) wherein the resulting blend possesses a pH of about 2.2 to about 2.8 to which is added a coagulant, such as a polymetal halide, to initiate flocculation or aggregation of the blend components;

(iv) heating the resulting mixture of (iii) below about the glass transition temperature (Tg) of the noncrosslinked latex resin to form toner sized aggregates;

(v) adding to the formed toner aggregates a latex comprised of a noncrosslinked resin suspended in an aqueous phase containing an ionic surfactant and water, and stirring for a period of time to permit stabilization of the aggregate particle size;

(vi) adding to the resulting mixture of (v) an aqueous solution of a silicate salt dissolved in a base to thereby change the pH, which is initially from about 2 to about 2.8, to arrive at a pH of from about 7 to about 7.5, and allowing the mixture to stir for a period of about 5 to about 10 minutes to provide a coating of silica on the aggregate particles containing magnetite;

(vii) heating the resulting aggregate mixture of (vi) above about the Tg of the latex containing the noncrosslinked resin of (i);

(viii) retaining the mixture temperature at from about 85° C. to about 95° C. for an optional period of about 10 to about 60 minutes, followed by a pH reduction with an acid to arrive at a pH of about 4.2 to about 4.8, which pH is usually below the Pzc of the magnetite particles;

(ix) retaining the mixture temperature at from about 80° C. to about 95° C. for a period of about 5 to about 10 hours to assist in permitting the fusion or coalescence of the toner aggregates and to obtain smooth particles;

(x) washing the resulting toner slurry;

(xi) isolating the toner and drying; a process for the preparation of a MICR toner composition, which when analyzed for aluminum and silica contents contains about 70 to about 95 percent of aluminum and silica thereby providing a means of detection of how the toner was fabricated; a toner composition comprised of magnetite, a noncrosslinked latex, a crosslinked latex, wax, carbon black and a silica which is incorporated during particle fabrication as a coating rather than an external additive; a process wherein the magnetite dispersion contains an anionic surfactant and a nonionic surfactant wherever the dispersion possesses a pH of from about 6.5 to about 6.8; a process wherein the carbon black dispersion comprises particles dispersed in water and an anionic surfactant, and which dispersion possesses a pH of about 6.3 to about 6.8; a process wherein the wax dispersion comprises particles dispersed in water and an ionic surfactant; a process wherein the acicular magnetite is present in an amount of from about 20 to about 40 percent by weight of toner, and preferably in an amount of from about 23 to about 33 percent by weight of toner; a process wherein the acicular magnetite utilized exhibits a coercivity of from about 250 to about 700 Oe; a process wherein the acicular magnetite has a particle size of about 0.6 micron in length by 0.1 micron in diameter, and is comprised of about 21 percent FeO and about 79 percent $Fe_2O_3$; a process wherein the toner exhibits a magnetic signal of from about 115 to about 150 percent of the nominal signal; a process wherein the toner possesses a minimum fix temperature (MFT) of about 170° C. to about 190° C.; a process wherein the toner hot offset temperature (HOT) is in excess of about 210° C.; a process wherein the magnetite dispersion is obtained by a ball milling, attrition, polytroning or media milling resulting in magnetite particles dispersed in water containing an anionic surfactant; a process wherein the carbon black dispersion is present in an amount of about 4 to about 8 percent by weight of toner; a process wherein the latex resin particles are from about 0.15 to about 0.3 micron in volume average diameter; a process wherein the magnetite is of a size of about 0.6 micron to about 0.1 micron, and the carbon black is of a size of about 0.01 to about 0.2 micron in average volume diameter; a process wherein the acid is selected from the group consisting of nitric, sulfuric, hydrochloric, citric and acetic acid; a process wherein the base is selected in the form of a silicate salt dissolved in the base which silicate is selected from a group of sodium silicate or potassium silicate or magnesium sulfate silicate; a process wherein a silicate salt dissolved in the base is added to the toner size aggregates, which provides a coating of silica on the aggregates containing the magnetite or the iron oxide particles, rendering it substantially nonreactive, thus a toner process wherein the addition of a basic silicate salt provides a method to stabilize the toner size aggregates from further growth during coalescence, when the temperature of the aggregate mixture is raised above the resin Tg; a process wherein there is added to the formed toner size aggregates a latex comprised of noncrosslinked submicron resin particles suspended in an aqueous phase containing an anionic surfactant, and wherein the noncrosslinked latex is selected in an amount of from about 15 to about 40 percent by weight of the initial latex to form a shell on the formed aggregates, and which shell is of a thickness of, for example, about 0.2 to about 0.8 micron; a process wherein the added latex contains the same resin as the initial latex of (i), or wherein the added latex contains a dissimilar resin than that of the initial latex; a process wherein the pH of the mixture resulting in (vi) is increased from about 2 to about 2.6 to about 7 to about 7.5 with the addition of sodium silicate dissolved in sodium hydroxide, which addition components function as a stabilizer for the aggregates when the temperature of the coalescence (vi) is raised above the resin Tg; a process wherein the addition of a basic sodium silicate provides a reaction with iron oxide or magnetite, thereby allowing the pH during coalescence (viii) to be reduced to less than 5 to provide MICR toners; a process wherein the temperature at which toner sized aggregates are formed controls the size of the aggregates, and wherein the final toner size is from about 5 to about 12 microns in volume average diameter; a process wherein the aggregation temperature is from about 45° C. to about 60° C., and wherein the coalescence or fusion temperature is from about 85° C. to about 95° C.; a process wherein the time of coalescence or fusion is from about 5 to about 10 hours, and wherein there are provided toner particles with a smooth morphology; a process wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process for the preparation of a MICR toner comprising mixing (i) an acicular magnetite dispersion containing water and an anionic surfactant, and a colorant dispersion of carbon black containing water, an anionic surfactant, and a wax dispersion;

(ii) wherein the mixture of (i) is blended with a latex emulsion comprised of submicron noncrosslinked resin particles in the size range of about 200 to about 275 nanometers and containing water, an anionic surfactant or a nonionic surfactant, and a second latex comprised of submicron crosslinked polymer particles in the size range of about 75 to about 130 nanometers and containing water and an anionic surfactant or a nonionic surfactant;

(iii) wherein the resulting blend possesses a pH of about 2.4 to about 2.7, and there is added a cationic coagulant of a polyaluminum chloride to initiate flocculation or aggregation of the components of (i) and (ii);

(iv) heating the resulting mixture of (iii) below the glass transition temperature (Tg) of the noncrosslinked resin latex to form toner sized aggregates;

(v) adding to the formed toner aggregates a third latex comprised of a resin suspended in an aqueous phase containing an ionic surfactant and water;

(vi) adding to the resulting mixture of (v) an aqueous solution of a sodium silicate dissolved in sodium hydroxide to thereby change the pH, which is initially from about 2 to about 2.8, to arrive at a pH of from about 7 to about 7.4, allowing the silica to react with the magnetite particles;

(vii) heating the resulting aggregate suspension of (vi) above the Tg of the latex noncrosslinked resin of (i);

(viii) retaining the mixture temperature at from about 80° C. to about 95° C. for a period of about 10 to about 75 minutes, followed by a pH reduction with an acid to arrive at a pH of about 4.2 to about 4.8;

(ix) retaining the mixture temperature at from about 80° C. to about 95° C. for a period of about 5 to about 8 hours to assist in permitting the fusion or coalescence of the toner aggregates and to obtain smooth toner particles;

(x) washing the resulting toner slurry;

(xi) isolating the toner particles and drying in an oven; a toner process wherein there is selected a latex, a magnetite dispersion that contains water and an anionic surfactant, a colorant dispersion which contains carbon black, water and an anionic surfactant, and a wax dispersion comprised of submicron wax particles of from about 0.1 to about 0.9 micron in diameter by volume, and which wax is dispersed in an anionic surfactant;

(ii) wherein the latex is comprised of two latex emulsions, a noncrosslinked latex and a crosslinked latex, and wherein each of the latexes contain resin particles, water and an anionic surfactant;

(iii) adding to the resulting mixture with a pH of about 2 to about 3 a coagulant, and which coagulant is a polymetal halide, a cationic surfactant, or mixtures thereof to primarily enable flocculation of the resin latexes, the magnetite, the colorant, and the wax;

(iv) heating the resulting mixture below about the glass transition temperature (Tg) of the uncrosslinked latex resin to form toner sized aggregates;

(v) adding to the formed toner aggregates a latex comprised of noncrosslinked resin suspended in an aqueous phase containing an ionic surfactant and water;

(vi) adding to the resulting mixture of (v) an aqueous solution of a silicate dissolved in sodium hydroxide to thereby change the pH from an initial about 2 to about 2.9 to a pH of from about 7 to about 8;

(vii) heating the resulting aggregate suspension of (vi) to above the Tg of the latex resin of (i);

(viii) optionally retaining the mixture temperature at from about 70° C. to about 95° C. optionally for a period of about 25 to about 60 minutes, followed by a pH reduction with an acid to arrive at a pH of about 4 to about 5 to assist in permitting the fusion or coalescence of the toner aggregates;

(ix) further retaining the mixture temperature at from about 85° C. to about 95° C. for an optional period of about 4 to about 10 hours to assist in permitting the fusion or coalescence of the toner aggregates to obtain smooth particles; and (x) washing the resulting toner slurry; and isolating the toner; a process wherein the colorant dispersion contains an anionic surfactant; a process wherein the colorant is carbon black, and wherein the carbon black dispersion comprises carbon black particles dispersed in water and an anionic surfactant, and wherein the colorant is present in an amount of from about 4 to about 10 weight percent; a process wherein the amount of acicular magnetite selected is from about 20 to about 40 percent by weight of toner, and the coagulant is comprised of a first coagulant of a polymetal halide present in an amount of about 0.02 to about 2 percent by weight of toner, and a further second cationic surfactant coagulant present in an amount of about 0.1 to about 5 percent by weight of toner; a process wherein the amount of acicular magnetite selected is from about 23 to about 35 percent by weight of toner, and the amount of coagulant, which coagulant is a polymetal halide, is selected in an amount of about 0.05 to about 0.15 percent by weight of toner; a process wherein the acicular magnetite utilized exhibits a coercivity of from about 250 to about 700 Oe; a process wherein the acicular magnetite possesses a coercivity of from about 250 to about 500 Oe, a remanent magnetization (Br) of about 23 to about 39 emu/gram, and a saturation magnetization (Bm) of about 70 to about 90 emu/gram; a process wherein the toner exhibits a magnetic signal of about 90 to about 150 percent of the nominal where the nominal is a signal strength of about 100 percent; a process wherein the toner possesses a minimum fix temperature (MFT) of about 170° C. to about 195° C.; a process wherein the toner hot offset temperature (HOT) is from about 210° C. to about 250° C.; a process wherein the resin contains a carboxylic acid selected from the group comprised of acrylic acid, methacrylic acid, itaconic acid, beta carboxy ethyl acrylate, fumaric acid, maleic acid, cinnamic acid, and the like, and wherein the carboxylic acid is selected in an amount of from about 0.1 to about 10 weight percent; a process wherein a crosslinking component monomer is added to the resin, and wherein the monomer is optionally selected in an amount of from about 0.5 to about 15 percent by weight; a process wherein the latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein the coagulant is a polymetal halide; a toner process comprising the heating of a magnetite dispersion, a colorant dispersion, a latex emulsion free of crosslinking, a crosslinked latex emulsion, and a coagulant of a polymetal halide, and wherein the mixture is aggregated by heating below the latex uncrosslinked resin glass transition temperature; a process wherein there is optionally further included a second coagulant of a cationic surfactant coagulant; a process wherein the coagulant is polymetal halide of a polyaluminum chloride, a polyaluminum sulfosilicate, or a polyaluminum sulfate selected in an amount of about 0.05 to about 0.5 pph by weight of toner, and there optionally added to the mixture a second cationic surfactant coagulant of an alkylbenzyl dimethyl ammonium chloride in an amount, for example, of from about 0.1 to about 2 by weight of toner; a process wherein the wax dispersion contains a polyethylene wax, water, and an anionic surfactant, and wherein the wax is selected in an amount of from about 5 to about 20 weight percent; a process wherein the wax dispersion contains a polypropylene wax, water, and an anionic surfactant, and wherein the wax is selected in an amount of from about 5 to about 20 weight percent; a process wherein the optional second coagulant is selected from the group comprised of alkylbenzyl dimethyl ammonium chloride, dialkyl benzene-alkyl ammonium chloride, lauryl trimethyl ammonium chloride, alkylbenzyl methyl ammonium chloride, alkyl benzyl dimethyl ammonium bromide, benzalkonium chloride, and cetyl pyridinium bromide present in an amount of about 0.1 to about 5 percent by weight of toner; a toner composition process wherein the acicular magnetite possesses a coercivity of about 250 to about 700 Oe, a particle size of about 0.6 micron in length×0.1 micron in diameter, a coercivity of from about 250 to about 500 Oe, a remanent magnetization (Br) of about 23 to 39 emu/gram, and a saturation magnetization (Bm) of about 70 to about 90 emu/gram; a coercivity of about 345 Oe, a remanent magnetization (Br) of about 35 emu/gram, and a saturation magnetization (Bm) of about 85 emu/gram; a coercivity of about 370 Oe, a remanent magnetization (Br) of about 33 emu/gram, and a saturation magnetization (Bm) of about 83 emu/gram; a magnetite with a coercivity of about 270 Oe, a remanent magnetization (Br) of about 20 emu/gram, and a saturation magnetization (Bm) of about 79 emu/gram; a coercivity of from about 250 to about 400 Oe, a remanent magnetization (Br) of about 23 to about 55 emu/gram, and a saturation magnetization (Bm) of about 70 to about 90 emu/gram; and wherein the acicular magnetite is present in the toner in an amount of from about 10 to about 40 weight percent; a process wherein the acicular magnetite possesses a coercivity of about 250 to about 700 Oe, a particle size of about 0.6 micron in length×0.1 micron in diameter, a magnetite with a coercivity of from about 250 to about 500 Oe, a remanent magnetization (Br) of about 23 to about 39 emu/gram, and a saturation magnetization (Bm) of about 70 to about 90 emu/gram; and wherein the wax is a polyethylene, a polypropylene, or mixtures thereof; a process wherein the crosslinked resin is selected in an amount of from about 1 to about 40 weight percent; a process wherein the crosslinked resin is selected in an amount of from about 2 to about 25 weight percent; a process wherein the crosslinked resin is poly(styrene butylacrylate, beta carboxy ethyl acrylate divinyl benzene); a process wherein the resin free from crosslinking possesses a molecular weight $M_w$ of about 20,000 to about 500,000, and an onset glass transition (Tg) temperature of from about 45° C. to about 70° C.; a process wherein the crosslinked latex resin possesses a molecular weight $M_w$ of about 100,000 to about 1,000,000, and an onset glass transition (Tg) temperature of about 48° C. to about 58° C.; a process wherein the crosslinked resin latex is selected in an amount of from about 2 to about 15 weight percent, the latex free of a crosslinked resin is selected in an amount of from about 40 to about 65 weight percent, the magnetite is selected in an amount of from about 20 to about 35 weight percent, the wax is selected in an amount of from about 5 to about 15 weight percent, and wherein the total thereof is about 100 percent based on the toner; a process wherein the resulting toner possesses a shape factor of from about 110 to about 148; a process wherein the colorant dispersion contains colorant and an anionic surfactant; a process wherein colorant dispersion is comprised of carbon black particles dispersed in water and an anionic surfactant; a process wherein the amount of acicular magnetite selected is from about 15 to about 40 percent by weight of toner, and the coagulant is a polymetal halide present in an amount of about 0.02 to about 0.4 percent by weight of toner; a process where the coagulant is a cationic surfactant present in the amount of about 0.1 to about 2 percent by weight of toner; a process wherein the coagulant is comprised of a mixture of a polymetal halide and a cationic surfactant; a process wherein the amount of acicular magnetite selected is from about 23 to about 32 percent by weight of toner, and the amount of coagulant, which coagulant is a polymetal halide, is present in an amount of about 0.05 to about 0.13 percent by weight of toner and the optional cationic surfactant coagulant is present in an amount of about 0.15 to about 1.5 percent by weight of toner; a process wherein the noncrosslinked resin or polymer has a glass transition temperature (Tg) of about 45° C. to about 70° C.; a process wherein the noncrosslinked resin possesses a weight average molecular weight of about 20,000 to about 90,000; a process wherein the crosslinked latex contains a polymer, wherein the crosslinking percentage or value is, for example, from about 20 to about 75 percent, or about 25 to about 55 of poly(styrene-alkyl acrylate), poly(styrene-1,3-diene), poly(styrene-alkyl methacrylate), poly(alkyl methacrylate-alkyl acrylate), poly (alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), and poly(styrene-butyl acrylate-acrylononitrile), and wherein the polymer in addition contains a crosslinking component, such as divinyl benzene (DVB), to enable the crosslinked resin or polymer, and wherein the crosslinking component can be selected in an amount of from about 0.1 to about 15 weight percent; a process wherein the polymer, in addition to DVB, can contain a carboxylic acid, and which carboxylic acid is, for example, selected from the group comprised of acrylic acid, methacrylic acid, itaconic acid, beta carboxy ethyl acrylate; and the like, and wherein the carboxylic acid is present in an amount of from about 0.5 to about 10 weight percent; a process comprising the heating of a magnetite dispersion, a colorant dispersion, a latex emulsion, a crosslinked polymer, wherein the crosslinking is, for example, from about 30 to about 75 percent, and coagulants, wherein one of the coagulants is a polyaluminum chloride, or bromide, and the optional second coagulant is a cationic surfactant, such as an alkylbenzyl dimethyl ammonium chloride, and wherein the mixture is aggregated by heating below the latex uncrosslinked resin glass transition temperature, followed by the addition of a silicate salt dissolved in a base, and thereafter, heating above the latex uncrosslinked resin glass transition temperature; a process wherein the aggregate mixture pH value is about 7 to about 7.7 obtained by the addition of a silicate salt dissolved in a base like sodium hydroxide; a process wherein the acicular magnetite, which can be comprised of 21 percent FeO and 79 percent $Fe_2O_3$ is selected from the group consisting of B2510, B2540, B2550, HDM-S 7111 with a coercivity of from about 250 to about 500 Oe and a remanent magnetization (Br) of about 23 to about 39 emu/gram, and a saturation magnetization (Bm) of about 75 to about 90 emu/gram, all available from Magnox; MR-BL with a coercivity of about 340 Oe, a remanent magnetization (Br) of about 35 emu/gram, and a saturation magnetization (Bm) of about 85 emu/gram, all available from Titan Kogyo and Columbia Chemicals; MTA-740 with a coercivity of about 370 Oe, a remanent magnetization (Br) of about 35 emu/gram, and a saturation magnetization (Bm) of about 83 emu/gram, and all available from Toda Kogyo Inc.; AC 5151M with a coercivity of about 270 Oe, a remanent magnetization (Br) of 20 emu/gram, and a saturation magnetization (Bm) of 79 emu/gram, available from Bayer Corporation; MO4232, MO4431 with a coercivity of from about 250 to about 400 Oe, a remanent magnetization (Br) of about 23 to about 60 emu/gram, and a saturation magnetization (Bm) of about 70 to about 90 emu/gram, available from Elementis Inc.; wherein the toner exhibits a magnetic signal of from about 125 to about 150 percent of the nominal signal where nominal signal refers to the signal strength of 100 percent, and wherein the acicular magnetite selected is present in the toner in an amount, for example, of from about 10 to about 35 weight percent, and more specifically, in an amount of about 22 to about 32 weight percent by weight of toner; a toner process as illustrated herein wherein the amount of resin free of crosslinking is from about 40 to about 65 weight percent, the amount of crosslinked resin is from about 2 to about 15 weight percent; the amount of magnetite is from about 20 to about 35 weight percent; the colorant amount is from about 4 to about 10 weight percent; and the wax amount is from about 5 to about 15 weight percent; and the total of the components is 100 percent; a process for preparing a chemical toner wherein the blending and aggregation are performed at a pH of about 2 to about 3 or about 2 to about 2.8, while the coalescence is initially conducted at a pH of about 7 to about 8 followed by a reduction in pH to about 5.5 to about 6.5, and followed by further heating for a period of hours, for example, about 6 to about 12 hours; and a process for preparing a MICR toner composition by emulsion aggregation, which toner possesses a smooth shape and feel, and contains from about 20 to about 40 weight percent of an acicular magnetite, wax, crosslinked resin, and colorant, and with a toner particle size distribution of about 1.20 to about 1.26, and which toner provides a MICR signal of about 90 to about 140 percent and a bulk remanence of about 26 emu/gram wherein the remanence can be measured on a tapped powder magnetite sample in a cell of 1 centimeter×1 centimeter×about 4 centimeters. The sample is magnetized between two magnetic pole faces with a saturating magnetic field of 2,000 Gauss, such that the induced magnetic field is perpendicular to one of the 1×4 centimeter faces of the cell. The sample is removed from the saturating magnetic field, and the remanence is measured perpendicular to the above 1 centimeter wide face using a Hall-Effect device or a gaussmeter, such as the F. W. Bell, Inc. Model 615 gaussmeter.

The resin or polymer selected for the process of the present invention can be prepared by a number of known methods such as, for example, emulsion polymerization, including semicontinuous emulsion polymerization methods, and the monomers utilized in such processes can be selected from, for example, styrene, acrylates, methacrylates, butadiene, isoprene, acrylonitrile; monomers comprised of an A and a B monomer wherein from about 75 to about 95 percent of A and from about 5 to about 25 percent of B is selected, wherein A can be, for example, styrene, and B can be, for example, an acrylate, methacrylate, butadiene, isoprene, or an acrylonitrile; and optionally, acid or basic olefinic monomers, such as acrylic acid, methacrylic acid, beta carboxy ethyl acrylate, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of, for example, from about 0.01 micron to about 1 micron in diameter can be selected like polymer microsuspension process, such as those illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes; and toner processes wherein the resin possesses a crosslinking percentage of from about 1 to about 50 or from about 1.5 to about 30.

Colorants include dyes, pigments, and mixtures thereof, colorant examples being illustrated in a number of the copending applications referenced herein, and more specifically, which colorants include known colorants like black, cyan, red, blue, magenta, green, brown, yellow, mixtures thereof, and the like.

Crosslinked resin examples with crosslinking values as illustrated herein, and more specifically, of, for example, from about 25 to about 80, and more specifically, from about 30 to about 65 percent, and which resin is selected in various amounts, such as from about 1 to about 20, and more specifically, from about 5 to about 10 weight percent based on the weight percentages of the remaining toner components, include the resins illustrated herein, which resins are crosslinked by known crosslinking compounds, such as divinyl benzene. Specific crosslinked resin examples are poly(styrene divinyl benzene beta CEA), poly(styrene butyl acrylate divinyl benzene beta CEA), poly(styrene divinyl benzene acrylic acid), poly(styrene butyl acrylate divinyl benzene acrylic acid), and the like.

Examples of anionic surfactants include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN RK™, NEOGEN SC™ from Kao and the like. An effective concentration of the anionic surfactant is, for example, from about 0.01 to about 10 percent by weight, and more specifically, from about 0.1 to about 5 percent by weight of monomers used to prepare the toner polymer resin.

Examples of nonionic surfactants that may be, for example, included in the resin latex dispersions include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. A suitable concentration of the nonionic surfactant is, for example, from about 0.01 to about 10 percent by weight, and more specifically, from about 0.1 to about 5 percent by weight of monomers used to prepare the toner polymer resin.

Examples of the cationic surfactants, which are usually positively charged, selected for the toners and processes of the present invention include, for example, alkylbenzyl dimethyl ammonium chloride dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. A suitable amount of cationic surfactant can be selected, such as from about 0.2 to about 5 percent by weight of the toner components.

Examples of silicas include NALCO® 1115, NALCO® 2326, NALCO® 1130, NALCO® 1030, NALCO® 1040, NALCO® 1034A, NALCO® 2327, NALCO® 1050, NALCO® 1060, NALCO® 2329, all available from Nalco Chemical Company, SILIFOG® 30AK, SILIFOG® 40AK, SILIFOG® 50AK, SILIFOG® 30AC, SILIFOG® 40AC, SILIFOG® 50AC, SILIFOG® 20AKM, SILIFOG® 40AKL, SILIFOG® 50AKM, SILIFOG® 20ACM, SILIFOG® 40ACM, SILIFOG® 50ACM, SILIFOG® 10AC, SILIFOG® 10ACM, SILIFOG® 0ACS, all available from ESEL TechTra Inc., LEVASIL® available from Bayer Corporation, SNOWTEX® O, SNOWTEX® OS, SNOWTEX® OL available from Nissan Chemical Industries Ltd., LEVASIL®, 50, LEVASIL® 100, LEVASIL® 200 available from Bayer Corporation, BENDZIL® CAT, BANDZIL® CA 220, all available from EKA Chemicals; LUDOX® CL, LUDOX® SM 30, LUDOX® AM 30, LUDOX® TMA, LUDOX® TM 50, LUDOX® HS 40, LUDOX® SM 30, all available from Aldrich Chemicals; and the silicas illustrated in a number of the patent applications recited herein including those being filed concurrently herewith.

Counterionic coagulants selected for the processes illustrated herein can be comprised of organic, or inorganic components, and the like. For example, in embodiments the ionic surfactant of the resin latex dispersion can be an anionic surfactant, and the counterionic coagulant can be a polymetal halide or a polymetal sulfosilicate (PASS). Coagulants that can be included in amounts of, for example, from about 0.05 to about 10 weight percent include polymetal halides, polymetal sulfosilicates monovalent, divalent or multivalent salts optionally in combination with cationic surfactants, and the like. Inorganic cationic coagulants include, for example, polyaluminum chloride (PAC), polyaluminum sulfosilicate (PASS), aluminum sulfate, zinc sulfate, or magnesium sulfate.

The coagulant is in embodiments present in an aqueous medium in an amount of from, for example, about 0.05 to about 10 percent by weight, and more specifically, in an amount of from about 0.075 to about 2 percent by weight. The coagulant may also contain minor amounts of other components, such as for example nitric acid. The coagulant is usually added slowly while continuously subjecting the mixture resulting to high shear, for example, by stirring with a blade at about 3,000 to about 10,000 rpm, and preferably about 5,000 rpm, for about 1 to about 120 minutes. A high shearing device, for example an intense homogenization device, such as the in-line IKA SD-41, may be used to ensure that the coagulant is homogeneous and uniformly dispersed.

Examples of waxes include those as illustrated herein, such as those of the aforementioned copending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected possess, it is believed, a molecular weight $M_w$ of from about 500 to about 15,000, while the commercially available polypropylenes are believed to have a molecular weight of from about 3,000, to about 7,000. Examples of functionalized waxes are amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsions, for example JONCRYL 74™, 89™, 130™, 537™, and 538™, all available from SC Johnson Wax; chlorinated polypropylenes and polyethylenes available from Allied Chemical and Petrolite Corporation and SC Johnson Wax. The amounts of the wax selected in embodiments is, for example, from about 3.5 to about 15 percent by weight of toner.

Examples of dispersants other than surfactants that can be suitable for dispersing the magnetite pigment particles include functional copolymers, such as for example methyl vinyl ether-maleic acid, methyl vinyl ethermaleic acid calcium sodium salt, hydrophobically modified polyethers, polyvinylpyrrolidone homopolymers, alkylated vinylpyrrolidone copolymers, vinyl acetate/vinylpyrrolidone copolymers, vinylpyrrolidone/styrene block, poly(methyl vinyl ether/maleic anhydride) (linear interpolymer with 1:1 molar ratio), dimethylaminoethyl methacrylate, ethylene-vinyl acetate copolymer of maleic anhydride and acrylic acid, polystyrene-maleic anhydride, styrene-acrylic ester, ethyl acrylate/methyl methacrylate, carboxylated poly-n-butyl acrylates, and ethylene vinyl alcohol, and which, for example, permit the magnetite to be readily dispersible into a submicron particle size of, for example, about 30 to about 400 nanometers in either an acid or a base resulting in a magnetite pigment that can be stabilized by resin particles.

The solids content of the resin latex dispersion is not particularly limited, thus the solids content may be from, for example, about 10 to about 90 percent. With regard to the colorants, such as carbon black, in some instances they are available in the wet cake or concentrated form containing water, and can be easily dispersed utilizing a homogenizer or simply by stirring or ball milling, attrition, or media milling. In other instances, pigments are available only in a dry form whereby dispersion in water is effected by microfluidizing using, for example, a M-110 microfluidizer or an ultimizer, and passing the pigment dispersion from about 1 to about 10 times through a chamber by sonication, such as using a Branson 700 sonicator, with a homogenizer, ball milling, attrition, or media milling with the optional addition of dispersing agents such as the aforementioned ionic or nonionic surfactants.

During coalescence, the pH is increased, for example, from about 2 to about 3 to about 7 to about 8; from about 2 to about 2.8 to about 7 to about 7.5 by the addition of a suitable pH agent of, for example, sodium silicate dissolved in sodium hydroxide to provide for the stabilization of the aggregated particles and to prevent/minimize the toners size growth and loss of GSD during further heating, for example, increasing the temperature to about 10° C. to about 50° C. above the resin Tg. Also, the silicate can provide a coating of silica on the magnetite particles thereby lowering the Pzc of the magnetite such that during the coalescence where the pH of the mixture reduced to below about 5 and preferably about 4.5, the fusion of the aggregates can be accomplished by using an acid. Examples of pH reducing agents include, for example, nitric acid, citric acid, sulfuric acid or hydrochloric acid, and the like.

In embodiments of the present invention, a multi-stage addition of latex is conducted. In particular, a portion, for example about 20 to about 40 percent of the total amount of latex, is retained while the remainder is subjected to homogenization and aggregation. In these embodiments, a majority of the latex is added at the onset while the remainder of the latex (the delayed latex) is added after the formation of the resin aggregates. This delayed addition of the third or additional latex provides in embodiments an outer shell of nonpigmented material around the magnetite/colorant core, thereby encapsulating the pigment in the core of the particles and away from the toner particle surface.

In embodiments, the toner particles formed by processes illustrated herein possess, for example, an average volume diameter of from about 0.5 to about 25, and more specifically, from about 1 to about 10 microns, and narrow GSD characteristics of, for example, from about 1.05 to about 1.25, or from about 1.15 to about 1.25 as measured by a Coulter Counter. The toner particles also possess an excellent shape factor, for example, of 135 or less wherein the shape factor refers, for example, to the measure of toner smoothness and toner roundness, where a shape factor of about 100 is considered spherical and smooth without any surface protrusions, while a shape factor of about 150 is considered to be rough in surface morphology and the shape is like a potato.

The toner particles illustrated herein may also include known charge additives in effective amounts of, for example, from about 0.1 to about 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Specific additives include zinc stearate and AEROSIL R972® available from Degussa Chemical and each present in an amount of from about 0.1 to about 2 percent which can be added during the aggregation process or blended into the formed toner product, calcium stearate and the like.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

The following Examples are provided. Parts and percentages are by weight unless otherwise indicated and temperatures are in degrees Centigrade.

EXAMPLES—GENERAL

Preparation of Noncrosslinked Latex A:

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™ (anionic emulsifier 55 percent active ingredients) and 387 kilograms of deionized water was prepared by mixing these components for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of beta-CEA, 7.3 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the above aqueous surfactant phase at 80° C. to form seeds wherein "seeds" refer, for example, to the initial emulsion latex added to the reactor prior to the addition of the initiator solution, while being purged with nitrogen. The above initiator solution was then slowly charged into the reactor forming about 5 to about 12 nanometers of latex "seed" particles. After 10 minutes, the remainder of the emulsion was continuously fed in using metering pumps.

After the above monomer emulsion was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron diameter resin particles of styrene/butylacrylate/beta CEA suspended in an aqueous phase containing the above surfactant. The molecular properties resulting for the resin latex were $M_w$ (weight average molecular weight) of 35,000, $M_n$ of 10.6, as measured by a Gel Permeation Chromatograph, and a midpoint Tg of 55.8° C., as measured by a Differential Scanning Calorimeter, where the midpoint Tg is the halfway point between the onset and the offset Tg of the resin or polymer.

Preparation of the Crosslinked Latex B (50 Nanometers):

A crosslinked latex emulsion comprised of polymer particles generated from the emulsion polymerization of styrene, butyl acrylate and beta carboxy ethyl acrylate (β) CEA was prepared as follows. A surfactant solution of 4.08 kilograms of NEOGEN™ RK (anionic emulsifier) and 78.73 kilograms of deionized water was prepared by mixing these components for 10 minutes in a stainless steel holding tank. The holding tank was then purged with nitrogen for 5 minutes before transferring the resulting mixture into the above reactor. The reactor was then continuously purged with nitrogen while the contents were being stirred at 100 RPM. The reactor was then heated up to 76° C., and held there for a period of 1 hour.

Separately, 1.24 kilograms of ammonium persulfate initiator were dissolved in 13.12 kilograms of deionized water.

Also separately, a monomer emulsion was prepared in the following manner. 47.39 Kilograms of styrene, 25.52 kilograms of butyl acrylate, 2.19 kilograms of β-CEA, 0.729 kilogram of divinyl benzene (DVB) crosslinking agent, 1.75 kilograms of NEOGEN™ RK (anionic surfactant), and 145.8 kilograms of deionized water were mixed to form an emulsion. One (1) percent of the emulsion was then slowly fed into the reactor, while being purged with nitrogen, containing the aqueous surfactant phase at 76° C. to form "seeds". The initiator solution was then slowly charged into the reactor and after 40 minutes the remainder of the emulsion was continuously fed in using metering pumps over a period of 3 hours.

Once all the monomer emulsion was charged into the above main reactor, the temperature was held at 76° C. for an additional 4 hours to complete the reaction. Cooling was then accomplished and the reactor temperature was reduced to 35° C. The product was collected into a holding tank. After drying, the resin latex onset Tg was 53.5° C. The resulting latex was comprised of 25 percent resin, 72.5 percent water and 2.5 percent anionic surfactant. The resin had a ratio of 65:35:3 pph:1 pph of styrene:butyl acrylate:β-CEA:DVB. The mean particle size of the gel latex was 50 nanometers as measured on the disc centrifuge and had a crosslinking degree of 25 percent as measured by gravimetric method. Total output was 320.55 kilograms.

Wax and Pigment Dispersions:

The aqueous wax dispersion utilized in the following Examples was generated using waxes available from Baker-Petrolite, and more specifically, P850 wax with a low molecular weight $M_w$ of 850 and a melting point of 107° C., and NEOGEN RK™ as an anionic surfactant/dispersant. The wax particle diameter size was determined to be approximately 200 nanometers, and the wax slurry was at a solid loading of 30 percent (weight percent throughout).

A pigment dispersion, obtained from Sun Chemicals, was an aqueous dispersion containing carbon black (REGAL 330® about 19 percent), an anionic surfactant, 2 percent, and 79 percent water.

Example I

25 Percent Magnetite—PAC (0.1 pph, 2 pph of Colloidal Silica):

79 Grams of MAGNOX B2550™ acicular magnetite comprised of 21 percent FeO and 79 percent $Fe_2O_3$ having a particle size of about 0.6 micron×0.1 micron were added to 600 grams of water containing 1.3 grams of a 20 percent aqueous anionic surfactant (NEOGEN RK™) to which 30 grams of colloidal silica of 21 percent solids and 30 grams of water were added while being polytroned. To the mixture resulting was added a mixture comprising 85 grams of carbon black solution containing 18 percent solids, and 90 grams of a dispersion of a submicron of polyethylene P850 wax particles (30 percent solids) followed by the addition of 300 grams of anionic latex A above comprising submicron latex particles (40 percent solids) of styrene/butylacrylate/beta CEA, and 64 grams of the crosslinked latex B above of styrene/butylacrylate/divinyl benzene beta CEA (25.5 percent solids) while polytroned at speeds of 5,000 rpm for a period of 5 minutes. 300 Grams of water were added to reduce the viscosity of the resulting blend to which then was added an aqueous PAC (polyaluminum chloride) solution comprising 3.1 grams of 10 percent solids placed in 23 grams of 0.3M nitric acid.

The resulting blend was then heated to a temperature of 50° C. while stirring for a period of 240 minutes to obtain a particle size of 6.3 microns with a GSD of 1.21. 140 Grams of the above noncrosslinked latex (latex A) were then added to the aggregate mixture and stirred at 50° C. for an additional 30 minutes to provide a particle size of 6.6 microns and a GSD of 1.21. The aggregate mixture was then stabilized from further growth by changing the pH of the mixture from about 2.6 to about 7.3 by the addition of a 4 percent aqueous sodium hydroxide solution. The mixture was then heated to 93° C. during which the pH as measured by an Orion pH meter decreased to 6.4. After 30 minutes at 93° C., the measured particle size was 6.7 with a GSD of 1.21. After 60 minutes, the pH was reduced to 5.7 and then to 4.7. The mixture resulting was then further heated for an additional 25 minutes at a pH of 4.7 and the particle size obtained was 6.8 microns with a GSD of 1.23. The mixture was allowed to coalesce for a total of 480 minutes at a pH of 4.7 and a temperature of 93° C. resulting in a particle size of 6.8 with a GSD of 1.23. The resultant mixture was cooled and the toner obtained was washed 4 times with water and dried on the freeze dryer. The resulting toner was comprised of 25 percent magnetite, 5 percent crosslinked resin, 57.1 percent noncrosslinked resin, 4.4 percent carbon black, and 8.5 percent wax. The dried toner was submitted for elemental analysis where the aluminum content was reported to be 0.073 pph and 0.027 pph, was contained in the mother liquor, while the silica content was 1.6 percent in the toner and 0.4 percent was found to be in the mother liquor. The toner which was evaluated had a triboelectric charge of −22 $\mu$C/gram as compared to a toner prepared without colloidal silica which had a charge of −13 $\mu$C/gram.

Example II

30 Percent Magnetite—PAC (0.1 pph, −2.5 pph of Colloidal Silica OS):

93 Grams of MAGNOX B2550™ acicular magnetite comprised of 21 percent FeO and 79 percent $Fe_2O_3$, having a particle size of about 0.6 micron×0.1 micron were added to 600 grams of water containing 1.3 grams of a 20 percent aqueous anionic surfactant (NEOGEN RK™) to which 38 grams of colloidal silica (OS) of 21 percent solids and 30 grams of water were added while being polytroned. To this was added a mixture comprising 85 grams of a carbon black solution containing 18 percent solids, and 90 grams of a dispersion of submicron polyethylene P850 wax particles (30 percent solids) followed by the addition of 285 grams of anionic latex A comprising submicron latex particles (40 percent solids) of styrene/butylacrylate/beta CEA, and 64 grams of the crosslinked latex B of styrene/butylacrylate/divinyl benzene beta CEA (25.5 percent solids) while polytroned at speeds of 5,000 rpm for a period of 5 minutes. 300 Grams of water were added to reduce the viscosity of the resulting blend to which mixture was then added an aqueous PAC solution comprising 3.1 grams of 10 percent solids placed in 23 grams of 0.3M nitric acid.

The resulting blend was then heated to a temperature of 50° C. while stirring for a period of 170 minutes to obtain a particle size of 6.2 microns with a GSD of 1.20. 130 Grams of the above noncrosslinked latex (latex A) was then added to the aggregate mixture and stirred at 48° C. for an additional 30 minutes to provide a particle size of 6.5 microns and a GSD of 1.20. The aggregate mixture was then stabilized from further growth by changing the pH of the mixture from about 2.6 to about 7.1 with the addition of a 4 percent aqueous sodium hydroxide solution. The mixture was then heated to 93° C. during which the pH decreased to 6.5. After 10 minutes at 93° C. the measured particle size was 6.7 microns with a GSD of 1.20. After 60 minutes the pH was reduced to 4.7. The mixture was then further heated for an additional 25 minutes at a pH of 4.7, and the particle size obtained was 6.6 microns with a GSD of 1.23. The mixture was allowed to coalesce for a total of 480 minutes at a pH of 4.7 and a temperature of 93° C., resulting in a particle size of 6.7 with a GSD of 1.24. The resultant mixture was cooled and the toner obtained was washed 4 times with water and dried on a freeze dryer. The resulting toner was comprised of 30 percent magnetite, 5 percent of crosslinked resin, 52.1 percent of noncrosslinked resin, 4.4 percent of carbon black, and 8.5 percent of wax. The dried toner was submitted for elemental analysis where the aluminum content was reported to be 0.078 pph (0.1 pph used for coagulation) and 0.022 pph was found to be in the mother liquor, while the silica content was 2.2 percent (pph) in the toner, and 0.3 percent was found to be in the mother liquor.

Each of the toners prepared possessed a suitable shape factor of, for example, about 125 to about 145, and more specifically, 135.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A toner process comprising heating a mixture of an acicular magnetite dispersion, a colorant dispersion, a wax dispersion, a first latex containing a crosslinked resin, a second latex containing a resin substantially free of crosslinking, a coagulant and a silica, and wherein the toner resulting possesses a shape factor of from about 120 to about 150.

2. A process in accordance with claim 1 wherein said silica is a colloidal silica and is incorporated into said toner by an in situ process, and wherein said shape factor is about 130 to about 140.

3. A process in accordance with claim 1 wherein said silica is comprised of colloidal silica particles of a size diameter of from about 0.003 to about 0.08 micron.

4. A process in accordance with claim 1 comprising (i) mixing said acicular magnetite dispersion containing water and an anionic surfactant, or a nonionic surfactant, and said colorant dispersion containing carbon black, water and an anionic surfactant, and optionally a nonionic surfactant, and a colloidal silica dispersion containing water and an anionic surfactant, and wherein said wax dispersion is comprised of submicron wax particles of from about 0.1 to about 0.5 micron in diameter by volume, and which wax is dispersed in water and an anionic surfactant;

(ii) wherein the resulting mixture is blended with said latex comprised of submicron substantially noncrosslinked resin particles of about 150 to about 300 nanometers in diameter and containing water, an anionic surfactant or a nonionic surfactant, and said crosslinked latex is comprised of submicron gel particles of about 30 to about 150 nanometers in diameter containing water and an anionic surfactant or a nonionic surfactant;

(iii) wherein the resulting blend possesses a pH of about 2.2 to about 2.8 to which is added said coagulant to initiate flocculation or aggregation of said resulting blended components;

(iv) heating the resulting mixture of (iii) below about the glass transition temperature (Tg) of the noncrosslinked latex resin to form aggregates;

(v) optionally adding to the formed aggregates a third latex comprised of resin suspended in an aqueous phase containing an ionic surfactant and water, and optionally stirring for a period of time to permit stabilization of the aggregate particle size;

(vi) adding to the resulting mixture of (v) an aqueous solution of a base to thereby change the pH, which is initially from about 2 to about 2.8, to arrive at a pH of from about 7 to about 7.5;

(vii) heating the resulting aggregate mixture of (vi) above about the Tg of the latex containing said substantially noncrosslinked resin, and allowing the pH to decrease;

(viii) retaining the mixture temperature at from about 85° C. to about 95° C. for an optional period of about 10 to about 60 minutes, followed by a pH reduction with an acid to arrive at a pH of about 4.2 to about 4.8, and optionally, which pH is below about the Pzc of said magnetite;

(ix) optionally retaining the mixture temperature at from about 85° C. to about 95° C. for an optional period of about 5 to about 10 hours to assist in permitting the fusion or coalescence of the toner aggregates and to obtain smooth particles;

(x) washing tile resulting toner slurry; and (xi) isolating the toner product.

5. A process in accordance with claim 4 (viii) wherein said Pzc is the pH where said particles are substantially free of a positive or a negative charge.

6. A process in accordance with claim 4 wherein said silica is a colloidal silica which forms a coating on said magnetite rendering it substantially insensitive to pH fluctuations, and optionally wherein for said magnetite the Zero Charge (Pzc) is rendered ineffective.

7. A process in accordance with claim 4 wherein the pH of (viii) is reduced to about 4.5, which pH is lower than the Pzc of the uncoated magnetite at pH of 5.3 without any significant change in the toner particle size.

8. A process in accordance with claim 1 wherein said silica comprises silicon dioxide ($SiO_2$) and a stabilizing counterion of sodium, potassium or ammonium ions, and said coagulant is a polymetal halide.

9. A process in accordance with claim 1 wherein said silica is comprised of silicon dioxide ($SiO_2$) and sodium ion oxide ($Na_2O$), and wherein the $SiO_2$:$Na_2O$ weight ratio is from about 100:1 to about 1,000:1.

10. A process in accordance with claim 1 wherein about 75 to about 95 percent of said silica, introduced in the form of a silicate, is retained in said toner.

11. A process in accordance with claim 1 wherein said coagulant is selected from the group consisting of polyaluminum chloride (PAC), polyaluminum sulfo silicate (PASS), aluminum sulfate, zinc sulfate, and magnesium sulfate.

12. A process in accordance with claim 11 wherein about 80 to about 90 percent of said coagulant metal ion is retained in said toner.

13. A process in accordance with claim 1 wherein said colorant is carbon black, and wherein said carbon black dispersion comprises carbon black particles dispersed in water and an anionic surfactant, and wherein said carbon black is present in an amount of from about 4 to about 10 weight percent.

14. A process in accordance with claim 1 wherein the amount of acicular magnetite selected is from about 20 to about 40 percent by weight of toner, and said coagulant is comprised of a polymetal halide present in an amount of about 0.02 to about 2 percent by weight of toner, and optionally, further a second cationic surfactant coagulant is present in an amount of about 0.1 to about 5 percent by weight of toner.

15. A process in accordance with claim 1 wherein the amount of acicular magnetite selected is from about 23 to about 35 percent by weight of toner, and wherein the coagulant is a polymetal halide selected in an amount of about 0.05 to about 0.15 percent by weight of toner.

16. A process in accordance with claim 1 wherein said acicular magnetite exhibits a coercivity of from about 250 to about 700 Oe.

17. A process in accordance with claim 1 wherein said acicular magnetite possesses a coercivity of from about 250 to about 500 Oe, a remanent magnetization (Br) of about 23 to about 39 emu/gram, and a saturation magnetization (Bm) of about 70 to about 90 emu/gram, and optionally wherein said acicular magnetite is present in said toner in an amount of from about 10 to about 40 weight percent.

18. A process in accordance with claim 1 wherein the toner exhibits a magnetic signal of about 90 to about 150 percent of the nominal where the nominal is a signal strength of about 100 percent.

19. A process in accordance with claim 1 wherein the crosslinked resin contains resin particles of from about 0.15 to about 0.4 micron in volume average diameter, and said second latex contains a resin free of crosslinking.

20. A process in accordance with claim 1 wherein said magnetite is from about 0.6 micron to about 0.1 micron in average volume diameter, and said colorant is carbon black, and said carbon black is from about 0.01 to about 0.2 micron in average volume diameter.

21. A process in accordance with claim 4 wherein said acid is nitric, sulfuric, hydrochloric, citric or acetic acid, and said coagulant is a polyaluminum chloride, and optionally wherein there is added to the formed toner aggregates of (v) said (third) latex comprised of submicron resin particles suspended in an aqueous phase containing an anionic surfactant, and wherein said second latex is selected in an amount of from about 10 to about 40 percent by weight of the initial latex (i) to form a shell thereover on said formed aggregates, and which shell is of an optional thickness of about 0.2 to about 0.8 micron.

22. A process in accordance with claim 4 wherein the pH of the mixture resulting in (vi) is increased from about 2 to about 2.6 to about 7 to about 7.2, and wherein said silica originating from silicate salt dissolved in a base functions primarily as a stabilizer for the aggregates during coalescence (vii), and minimal toner particle size increase results, and wherein said coagulant is a polymetal halide.

23. A process in accordance with claim 4 wherein the aggregation (iv) temperature is from about 45° C. to about 60° C., and wherein the coalescence or fusion temperature of (vii) and (viii) is from about 85° C. to about 95° C.

24. A process in accordance with claim 1 wherein said first or said second latex resin is selected from the group comprised of poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly( methylstyrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene) poly(butyl methacrylate-isoprene), poly(methyl acrylate-isoprene), poly(ethyl acrylate-isoprene), poly(propyl acrylate-isoprene), poly(butyl acrylate-isoprene); poly (styrene-propyl acrylate), poly(styrene-butyl acrylate), poly (styrene-butadiene-acrylonitrile), and poly(styrene-butyl acrylate-acrylononitrile).

25. A process in accordance with claim 24 wherein said resin contains a carboxylic acid selected from the group comprised of acrylic acid, methacrylic acid, itaconic acid, beta carboxy ethyl acrylate, fumaric acid, maleic acid, and cinnamic acid, and optionally wherein said carboxylic acid is selected in an amount of from about 0.1 to about 10 weight percent.

26. A process in accordance with claim 1 wherein said coagulant is a polymetal halide of a polyaluminum chloride, a polyaluminum sulfosilicate, or a polyaluminum sulfate, and there is further added to the mixture a second cationic surfactant coagulant of an alkylbenzyl dimethyl ammonium chloride.

27. A process in accordance with claim 1 wherein said wax dispersion contains a polyethylene, polypropylene, water, and an anionic surfactant, and wherein said wax is selected in an amount of from about 5 to about 20 weight percent.

28. A process comprising heating a mixture of an acicular shaped magnetite dispersion, a black colorant dispersion, a crosslinked resin latex, a latex containing a resin free of crosslinking, and a coagulant, and wherein said heating involves a first heating and subsequently a second heating, and which second heating is at a higher temperature than said first heating, said second heating being above about the glass transition temperature (Tg) of said resin free of crosslinking.

29. A process in accordance with claim 1 wherein said first latex contains a crosslinked resin of a poly(styrene butylacrylate, beta carboxy ethyl acrylate divinyl benzene).

30. A process in accordance with claim 1 wherein said resin free from crosslinking possesses a molecular weight $M_w$ of about 20,000 to about 500,000, and an onset glass transition (Tg) temperature of from about 45° C. to about 55° C., wherein said first latex crosslinked resin is selected in an amount of from about 1 to about 40 weight percent, and said resin possesses a molecular weight $M_w$ of from about 100,000 to about 1,000,000, and an onset glass transition (Tg) temperature of about 48° C. to about 58° C., and wherein said crosslinked resin latex is selected in an amount of from about 2 to about 15 weight percent, said latex free of a crosslinked resin is selected in an amount of iron about 40 to about 65 weight percent, said magnetite is selected in an amount of from about 20 to about 35 weight percent, said wax is selected in an amount of from about 5 to about 15 weight percent, and wherein the total thereof of said components is about 100 percent based on said tone.

31. A process comprising heating a magnetite, a latex containing a crosslinked polymer, a latex containing a polymer substantially free of crosslinking, a coagulant, and a colloidal silica, and wherein said heating involves a first heating equal to about or below about the Tg of said resin free of crosslinking, and a second heating equal to about or above about the Tg of said resin free of crosslinking.

32. A process in accordance with claim 1 wherein the coagulant is a polyaluminum chloride and the silica is a silicone dioxide.

* * * * *